US010874161B2

(12) United States Patent
Gotti

(10) Patent No.: US 10,874,161 B2
(45) Date of Patent: Dec. 29, 2020

(54) FOREHEAD SUPPORT BAND FOR HELMETS AND HELMET PROVIDED WITH SUCH FOREHEAD SUPPORT BAND

(71) Applicant: KASK S.p.A., Chiuduno (IT)

(72) Inventor: Angelo Gotti, Nembro (IT)

(73) Assignee: KASK S.P.A., Chiuduno (IT)

( * ) Notice: Subject to any disclaimer, the term of this patent is extended or adjusted under 35 U.S.C. 154(b) by 778 days.

(21) Appl. No.: 15/334,451

(22) Filed: Oct. 26, 2016

(65) Prior Publication Data

US 2017/0112221 A1 Apr. 27, 2017

(30) Foreign Application Priority Data

Oct. 27, 2015 (IT) ..... 102015000065907

(51) Int. Cl.
*A42B 3/08* (2006.01)
*A42B 3/14* (2006.01)
*A42B 3/32* (2006.01)

(52) U.S. Cl.
CPC ..... *A42B 3/08* (2013.01); *A42B 3/145* (2013.01); *A42B 3/324* (2013.01)

(58) Field of Classification Search
CPC .. A42B 3/08; A42B 3/085; A42B 3/14; A42B 3/145; A42B 3/324
USPC ..... 2/416, 417, 420, 421
See application file for complete search history.

(56) References Cited

U.S. PATENT DOCUMENTS 4,764,989 A 8/1988 Bourgeois
5,265,279 A * 11/1993 Mathis ..... A42B 3/10 2/181
5,337,420 A * 8/1994 Haysom ..... A42B 3/14 2/181
5,571,217 A * 11/1996 Del Bon ..... A42B 3/14 2/8.1
5,581,816 A * 12/1996 Davis ..... A42B 3/0473 2/410
5,826,279 A * 10/1998 Tencer ..... A42B 3/10 2/181
6,081,931 A * 7/2000 Burns ..... A42B 3/14 2/411
6,199,214 B1 3/2001 Campbell
(Continued)

FOREIGN PATENT DOCUMENTS

AU 3923468 A 12/1970
JP S6373323 U 5/1988
JP 2003064523 A 3/2003

OTHER PUBLICATIONS

Italian Search Report for Italian Application No. IO 59813 (2 Pages) (dated Jul. 6, 2016).
(Continued)

*Primary Examiner* — Katherine M Moran
(74) *Attorney, Agent, or Firm* — Lucas & Mercanti, LLP

(57) ABSTRACT

A forehead support band for work or sports protective helmets, having an elongated structure, and able to assume an arched configuration in the mounted condition on a respective helmet is provided. The structure has at least one fixing appendage, for its fixing to the helmet, interposed between two opposite ends of the structure. The band has two movable connection brackets for the engagement of the structure to the helmet and to a size-adjustment device arranged to engage a user's nape.

10 Claims, 6 Drawing Sheets

(56) References Cited

U.S. PATENT DOCUMENTS 6,264,392 B1 7/2001 Wise
6,367,085 B1 * 4/2002 Berg ..... A42B 3/145 128/201.24
7,213,271 B1 * 5/2007 Bielefeld ..... A42B 3/14 2/181
7,975,318 B2 * 7/2011 Zuber ..... A42B 3/145 2/410
8,214,920 B1 7/2012 Edgar
8,959,668 B1 * 2/2015 Ganes ..... A42B 3/08 2/410
10,299,530 B2 * 5/2019 Patel ..... A42B 3/085
2002/0116749 A1 * 8/2002 Bielefeld ..... A42B 3/14 2/416
2004/0163160 A1 * 8/2004 Oleson ..... A42B 3/14 2/410
2005/0138719 A1 * 6/2005 Huh ..... A42B 3/14 2/416
2007/0245466 A1 * 10/2007 Lilenthal ..... A42B 3/14 2/416
2007/0245467 A1 * 10/2007 Lilenthal ..... A42B 3/225 2/416
2009/0222978 A1 * 9/2009 Fang ..... A42B 3/085 2/421
2009/0241240 A1 10/2009 Han
2009/0293180 A1 * 12/2009 Grau ..... A42B 3/145 2/417
2009/0320186 A1 * 12/2009 Petzl ..... A42B 3/145 2/417
2009/0320187 A1 * 12/2009 Petzl ..... A42B 3/14 2/417
2010/0229274 A1 * 9/2010 Ahlgren ..... A42B 3/225 2/8.2
2010/0229286 A1 * 9/2010 Ahlgren ..... A42B 3/142 2/416
2010/0235971 A1 * 9/2010 Ahlgren ..... A42B 3/14 2/416
2011/0265236 A1 11/2011 Stoll
2011/0289659 A1 * 12/2011 Lanez ..... A42B 3/145 2/411
2012/0144565 A1 * 6/2012 Huh ..... A61B 90/35 2/421
2012/0144567 A1 * 6/2012 Huh ..... A42B 3/14 2/424
2012/0291173 A1 * 11/2012 Gleason ..... A41D 13/1184 2/10
2012/0297520 A1 * 11/2012 Gleason ..... A42B 3/142 2/181
2013/0111653 A1 * 5/2013 Huh ..... A42B 3/122 2/421
2013/0191973 A1 * 8/2013 Pfanner ..... A42B 3/145 2/421
2013/0205477 A1 * 8/2013 Pfanner ..... A42B 3/166 2/416
2013/0205478 A1 * 8/2013 Pfanner ..... A42B 3/085 2/421
2013/0239303 A1 * 9/2013 Cotterman ..... A42B 3/08 2/417
2013/0312163 A1 * 11/2013 Van Waes ..... A42B 3/145 2/421
2014/0053307 A1 * 2/2014 Cheng ..... A61F 9/06 2/8.2
2014/0101828 A1 * 4/2014 Sugerman ..... A42B 3/145 2/411
2014/0259286 A1 * 9/2014 Boyle ..... A41D 20/00 2/181
2015/0026871 A1 * 1/2015 Gotti ..... A42B 3/0406 2/418
2015/0040295 A1 * 2/2015 Pfanner ..... A42B 3/14 2/411
2015/0059057 A1 * 3/2015 Pfanner ..... A42B 3/10 2/209.3
2015/0059066 A1 * 3/2015 Ketterer ..... A42B 3/085 2/418
2015/0075534 A1 * 3/2015 Gulliver ..... A61M 16/0683 128/207.13

OTHER PUBLICATIONS

Italian Search Report for Italian Application No. IO 59814 (2 Pages) (dated Jul. 6, 2016).
International Search Report for Italian Application No. IO 59734 (2 Pages) (dated Jul. 6, 2016).
International Search Report for Italian Application No. IO 59765 (2 Pages) (dated Jul. 8, 2016).
International Search Report for Italian Application No. IO 59754 (2 Pages) (dated Jul. 8, 2016).

* cited by examiner

FOREHEAD SUPPORT BAND FOR HELMETS AND HELMET PROVIDED WITH SUCH FOREHEAD SUPPORT BAND

CROSS-REFERENCE TO RELATED APPLICATION

This application claims the benefit of Italian Patent Application No. 102015000065907 filed Oct. 27, 2015, the contents of which are incorporated herein by reference.

BACKGROUND OF THE INVENTION

The present invention relates to a forehead support band for helmets, in particular work or sports protective helmets.

It is also an object of the present invention a helmet, in particular work or sports protective helmet, provided with such forehead support band.

The object of the present invention belongs to the field of helmets, headpieces and/or similar safety protective headgears which can be used during the performing of dangerous and risky activities, such as those carried out in construction sites, mines, oil platforms, by fire-fighters, by first aid providers, by mountain climbers or those carried out in any field where it is necessary to protect the head of the users.

The object of the present invention is also suitable to be applied in the field of sports helmets, such as for example those intended for cycling, riding, skiing and for any other sports activity requiring the use of helmets.

As known, work protective helmets generally comprise a structure having at least one convex outer surface and at least one concave inner surface adapted to receive in engagement a user's head.

The inner surface is usually provided with a polystyrene protective shell for absorbing bumps and with possible paddings intended to improve the fit thereof.

In order to ensure the stability of the helmets on the head of the users, suitable headbands are also provided, developing almost completely along the whole profile of the concavity of the helmets for wrapping, in the operating condition of the latter, almost completely the head of the users.

The fixing of the above said headbands to the respective helmets is made by fixing a plurality of appendages developing on the upper part of the same. Such appendages are fixed directly to the inner surface of the respective helmet, whereby the respective headband remains suspended at the lower edge of the same.

In detail, the headband has a front portion intended to rest against the forehead of the user's head and side portions intended to adhere to the parietal areas of the user's head.

From laterally opposite sides around the headband two inner supporting appendages develop, to which the ends of a size-adjustment device are respectively hinged, which size-adjustment device is arranged to engage a user's nape.

In detail the support appendages are hinged to the inner surface of the headband, thereby having at least part of their structure overlapping the structure of the headband.

Although work helmets with headbands with inner supporting appendages for the size-adjustment devices are widely used, the Applicant has found that, however, they aren't exempt from some drawbacks and can be improved under different aspects, mainly in relation to the convenience, to the transverse encumbrance of the headband at the inner supporting appendages, to the comfort of the helmets in general and, especially, while using additional accessories, such as for example anti-noise earmuffs or alike, to the robustness of the structure at the supports of the size-adjustment devices, as well as in relation to the correct ascending and descending trajectory of the size-adjustment devices with respect to the respective helmets.

In particular, the Applicant has found that the presence of inner supporting appendages considerably increases the transverse encumbrance of the headbands, subsequently reducing the space intended for the head of the users.

Furthermore, by developing inside the structure of the headbands, the support appendages necessarily press against the parietal areas of the head of the users, with the risk of jeopardising the comfort of the respective helmets.

It should also be considered that the comfort of the above helmets can be seriously jeopardised when it is necessary to use some accessories, such as for example the anti-noise earmuffs exerting a pressure from the outside to the inside on the side parts of the headbands.

It should also be noted that the type of engagement of the inner supporting appendages with the headbands, as well as the structure that they form with such headbands does not allow to ensure the required structural robustness able to guarantee stable positions of the size-adjustment devices. In fact, the displacement of the size-adjustment devices during the ascending or descending stroke of the same can follow irregular trajectories.

SUMMARY AND OBJECTS OF THE INVENTION

The main purpose of the present invention is to provide a forehead support band for helmets and a helmet provided with such forehead support band able to solve the problems observed in the known technique.

A further purpose of the present invention is that of providing a forehead support band having reduced transverse encumbrance, especially at the engagement area of the respective size-adjustment device.

Another purpose of the present invention is to improve the fit and the comfort of helmets, especially while using additional accessories, such as for example anti-noise earmuffs or alike.

It is also a purpose of the present invention to provide a forehead support band having greater robustness at the respective size-adjustment device with respect to the headbands of the known technique.

It is a last purpose of the present invention, but therefore not less important than the others, to provide a forehead support band for guiding the ascent and descent of the respective size-adjustment device along a regular trajectory.

The above specified and yet further purposes are substantially achieved by a forehead support band for helmets and a safety helmet provided with such forehead support band, as stated and described in the following claims.

There is now provided, by way of example, the description of a preferred but not exclusive embodiment of a forehead support band for helmets and a helmet provided with such forehead support band.

BRIEF DESCRIPTION OF THE DRAWINGS

Such description will be made herein below with reference to the accompanying drawings, provided for indicative purposes only and therefore not limiting, wherein.

DETAILED DESCRIPTION OF THE INVENTION

With reference to the attached figures, number 1 indicates generally a forehead support band for helmets, in particular work or sports protective helmets.

Figure 1:
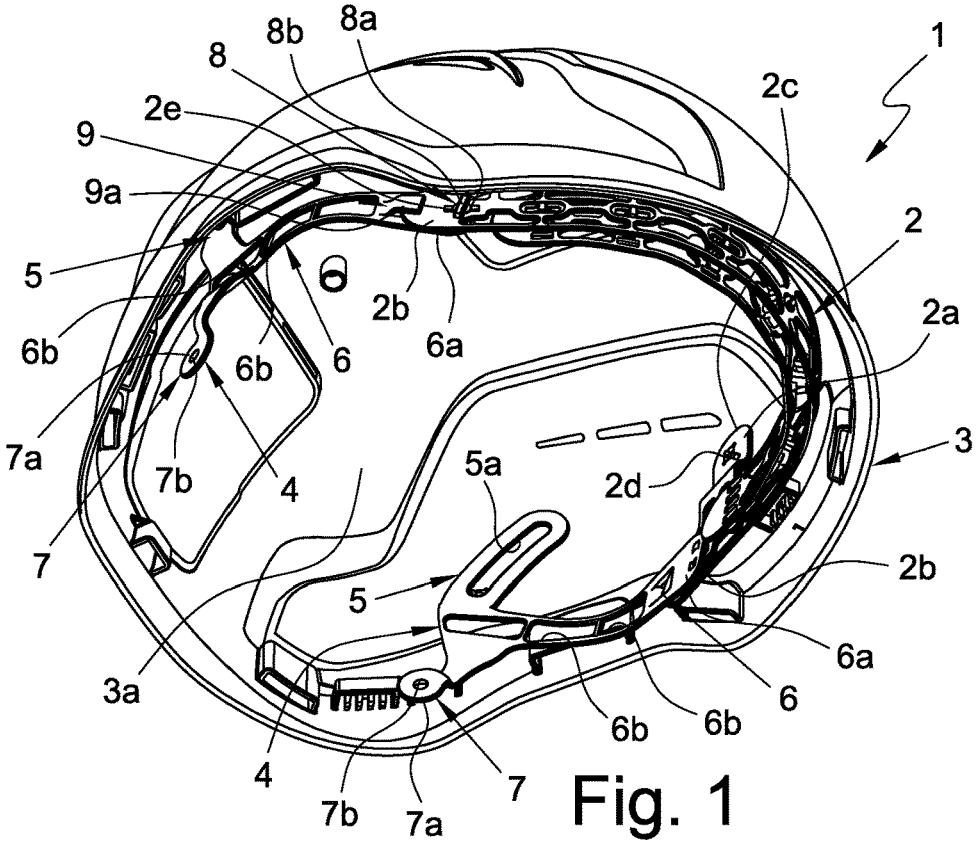
FIGS. 1 and 2 are perspective views of a forehead support band mounted on a helmet, in accordance with the present invention.
Figure 2:
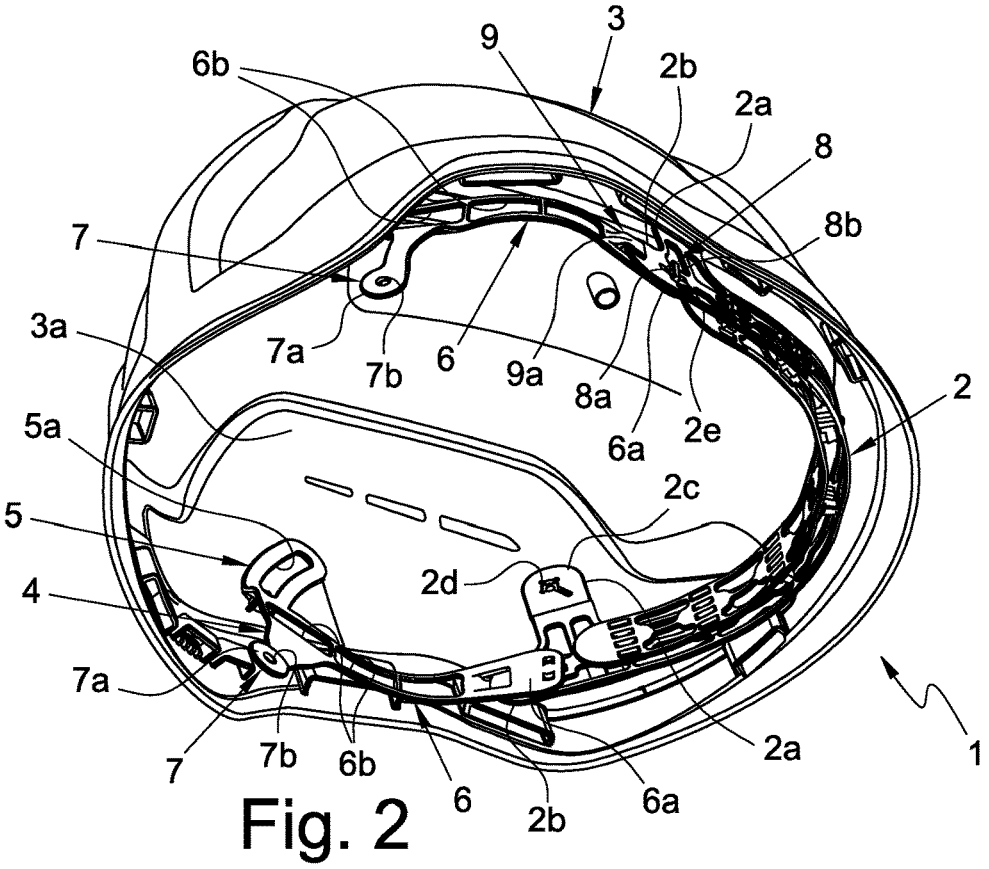
Figure 3:
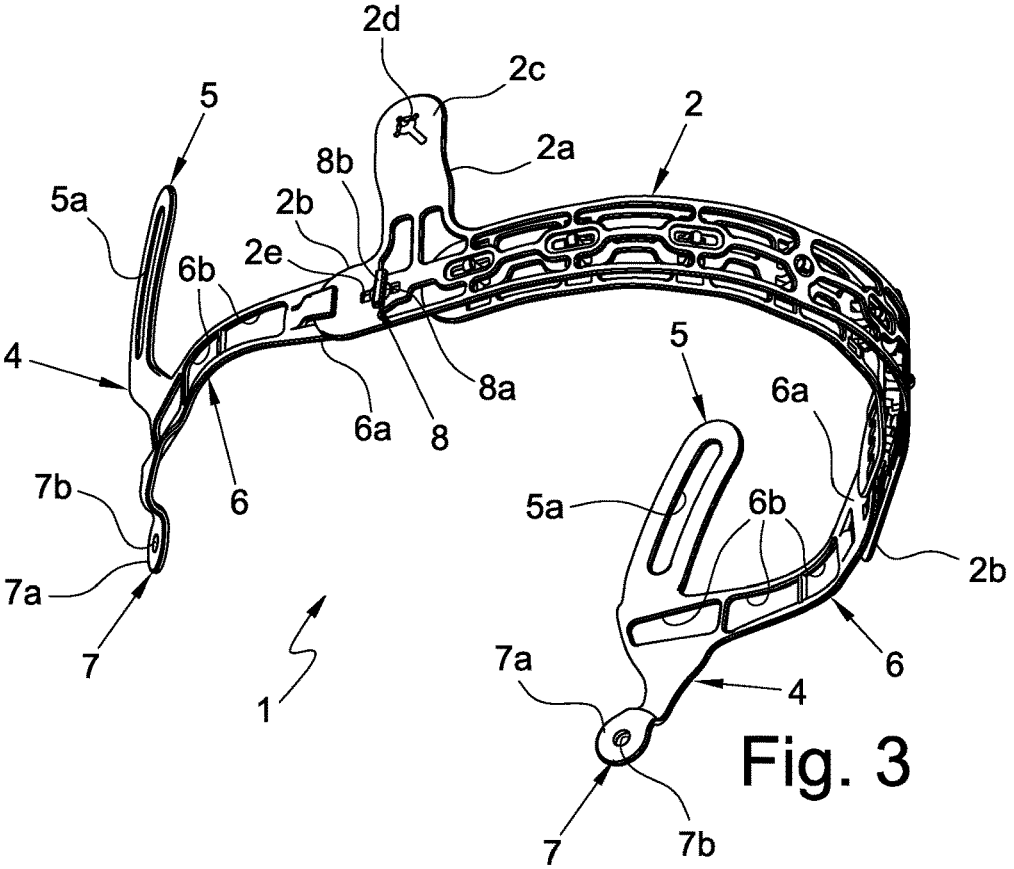
FIGS. 3 and 4 are perspective views of the forehead support band of FIGS. 1 and 2.
Figure 4:
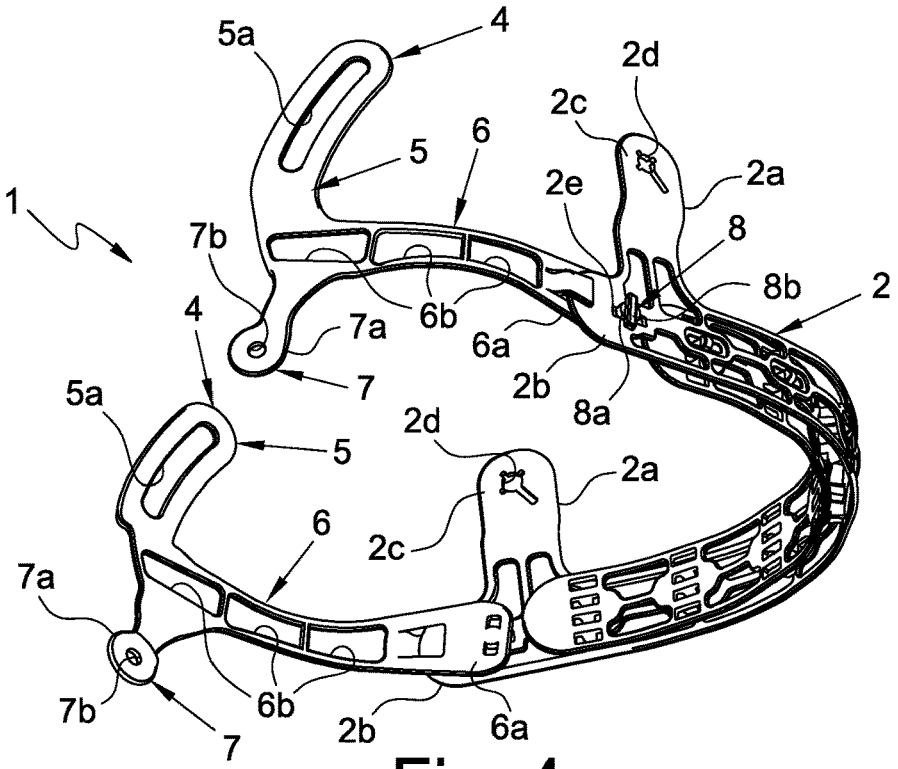
Figure 5:
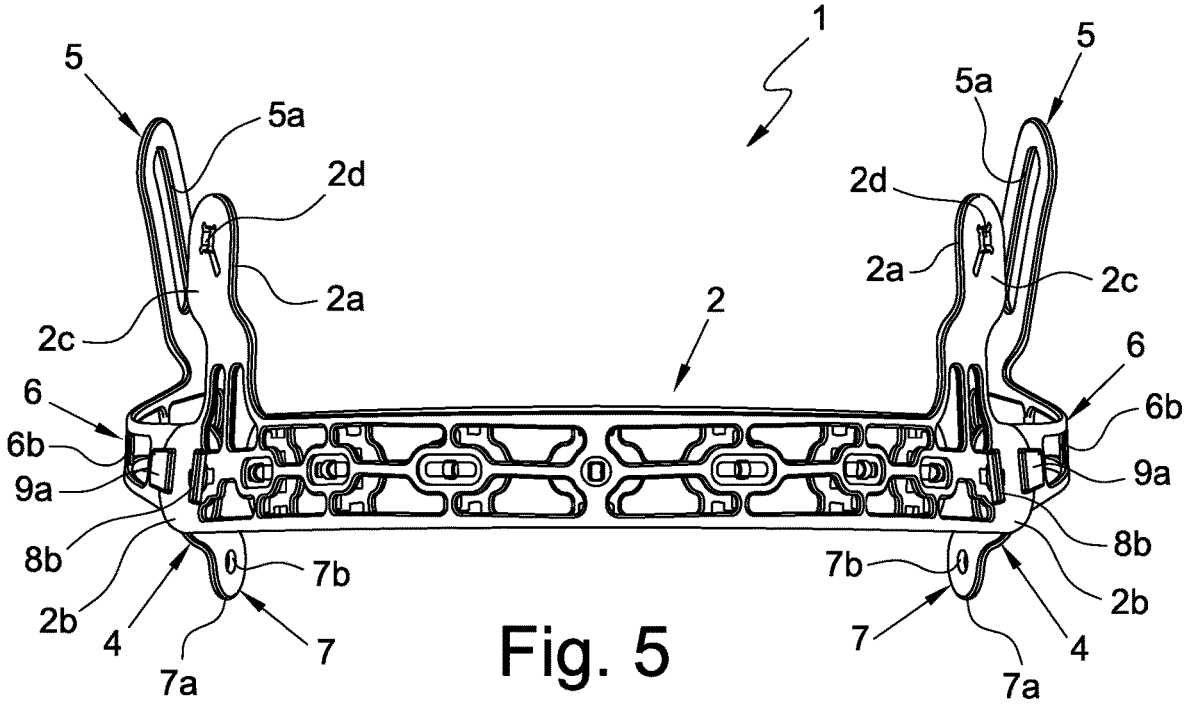
FIG. 5 is a front view of the forehead support band of FIGS. 1 to 4.
Figure 6:
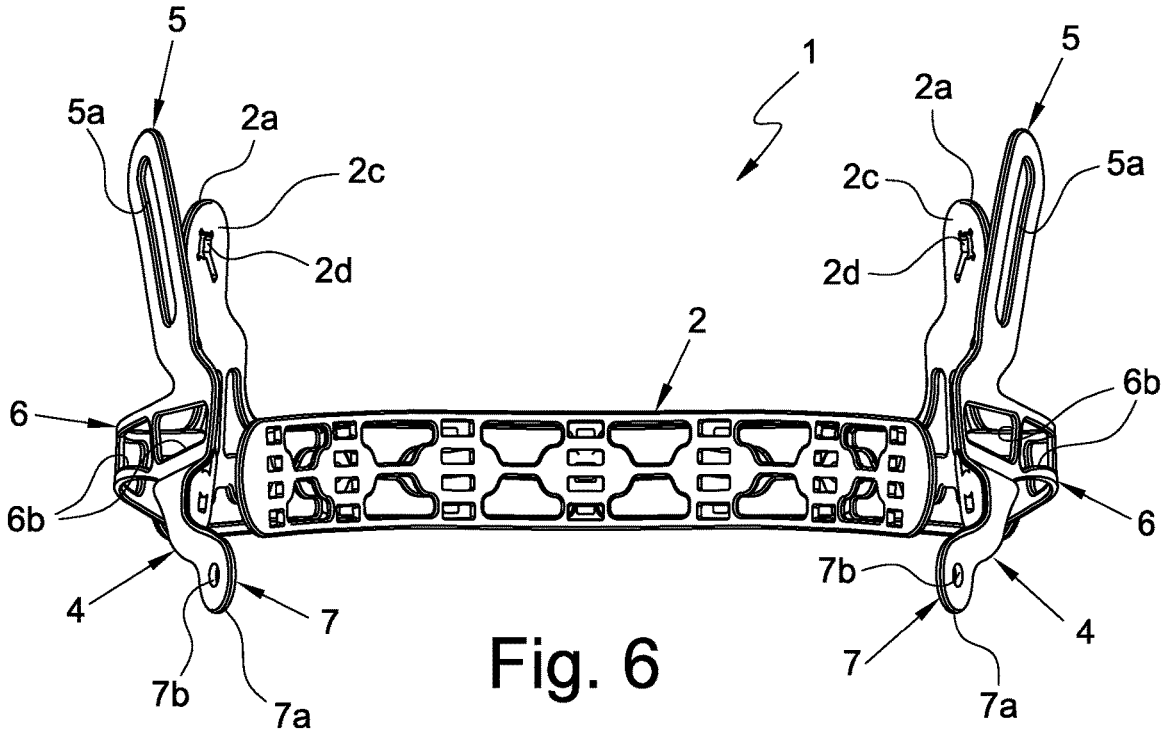
FIG. 6 is a rear view of the forehead support band of FIGS. 1 to 5.
Figure 7:
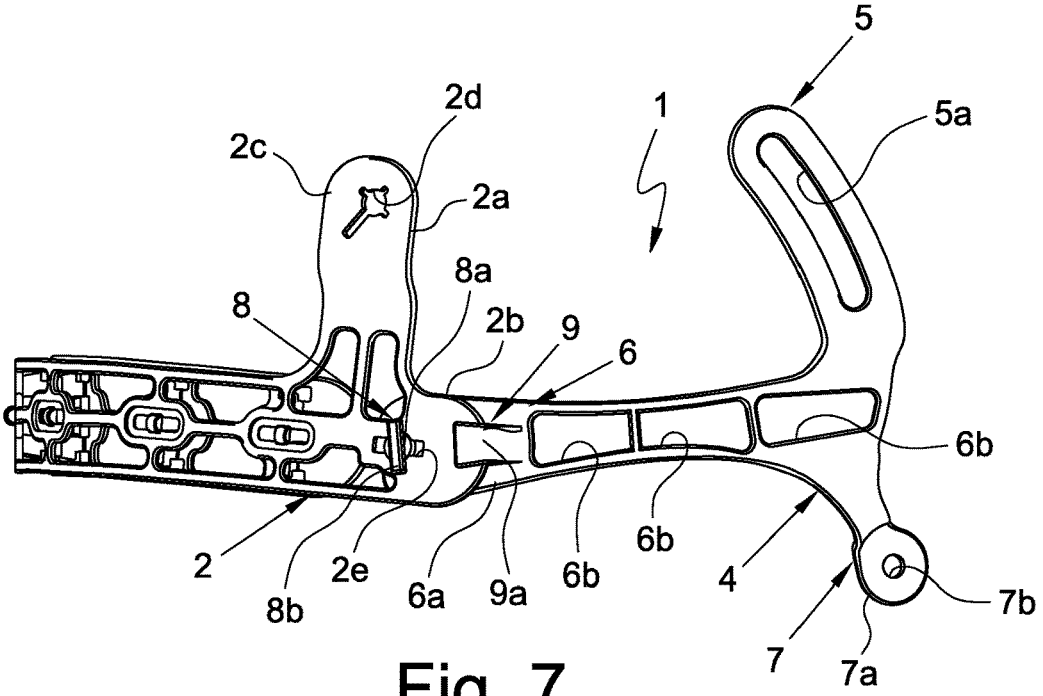
FIG. 7 is a side view of the forehead support band of FIGS. 1 to 6.
Figure 8:
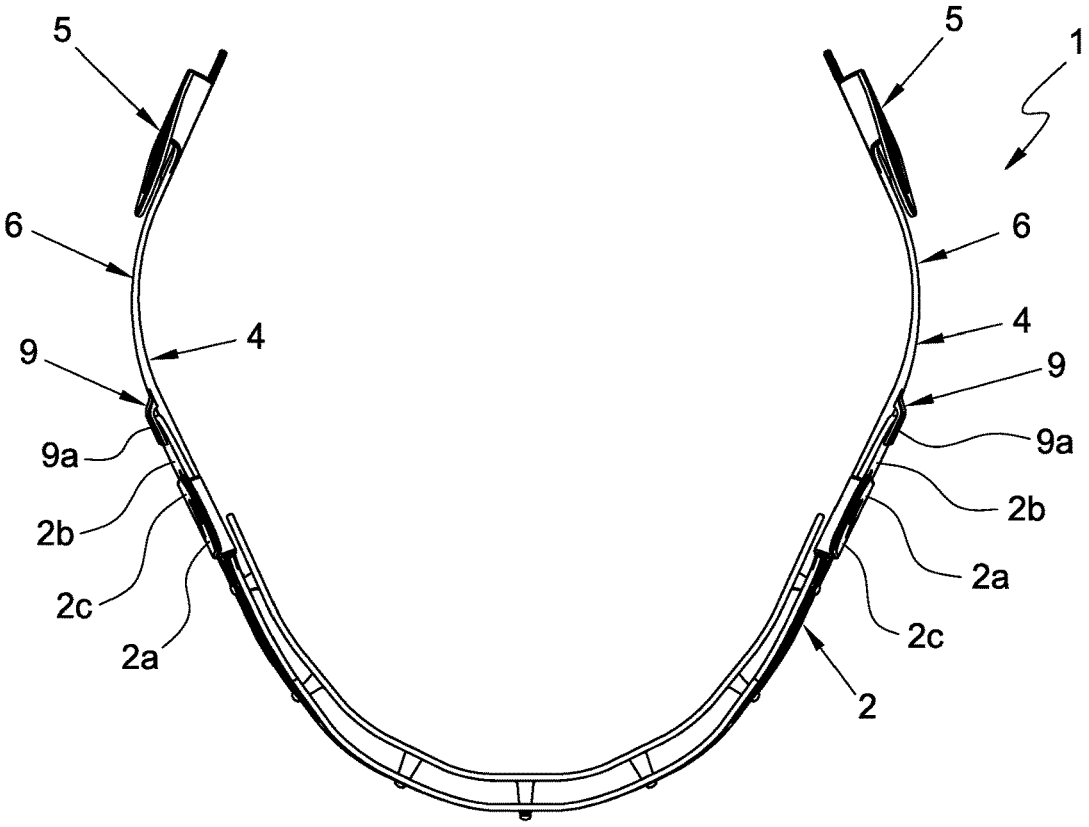
FIG. 8 is a top view of the forehead support band of FIGS. 1 to 7.
Figure 9:
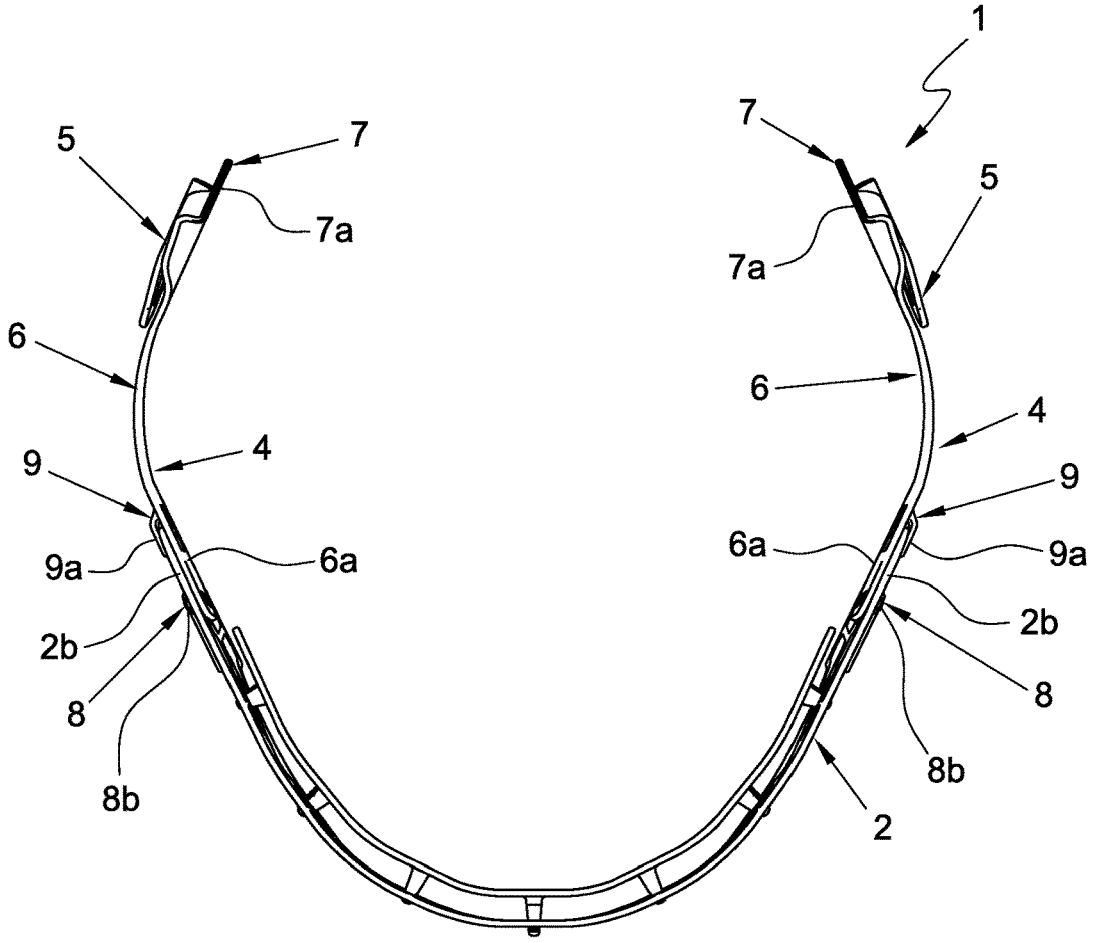
FIG. 9 is a bottom view of the forehead support band of FIGS. 1 to 8.
Figure 10:
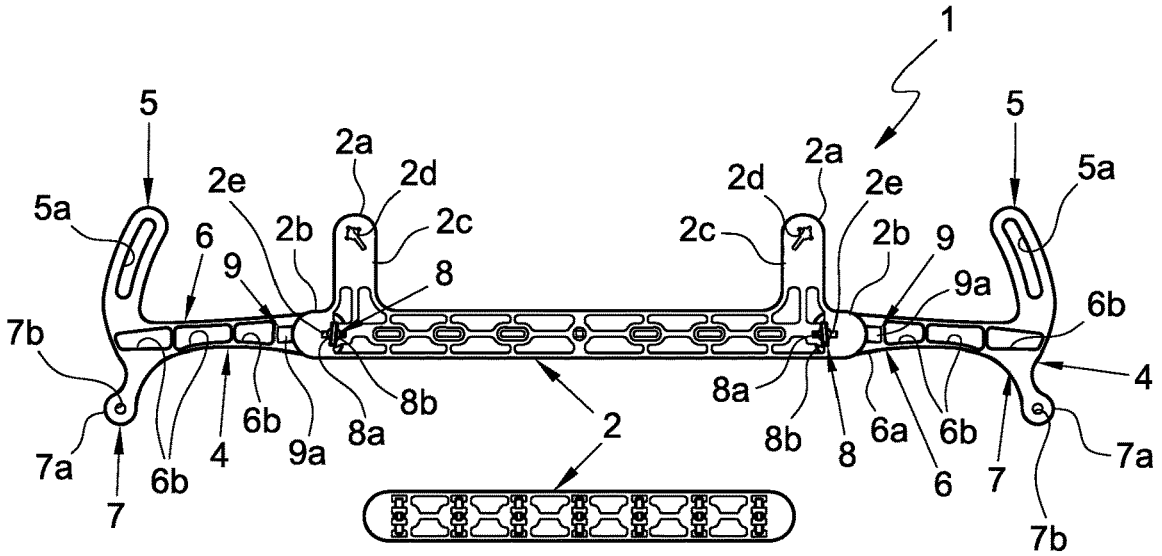
FIG. 10 shows the plane development of the components of the forehead support band of FIGS. 1 to 9.
Figure 11:
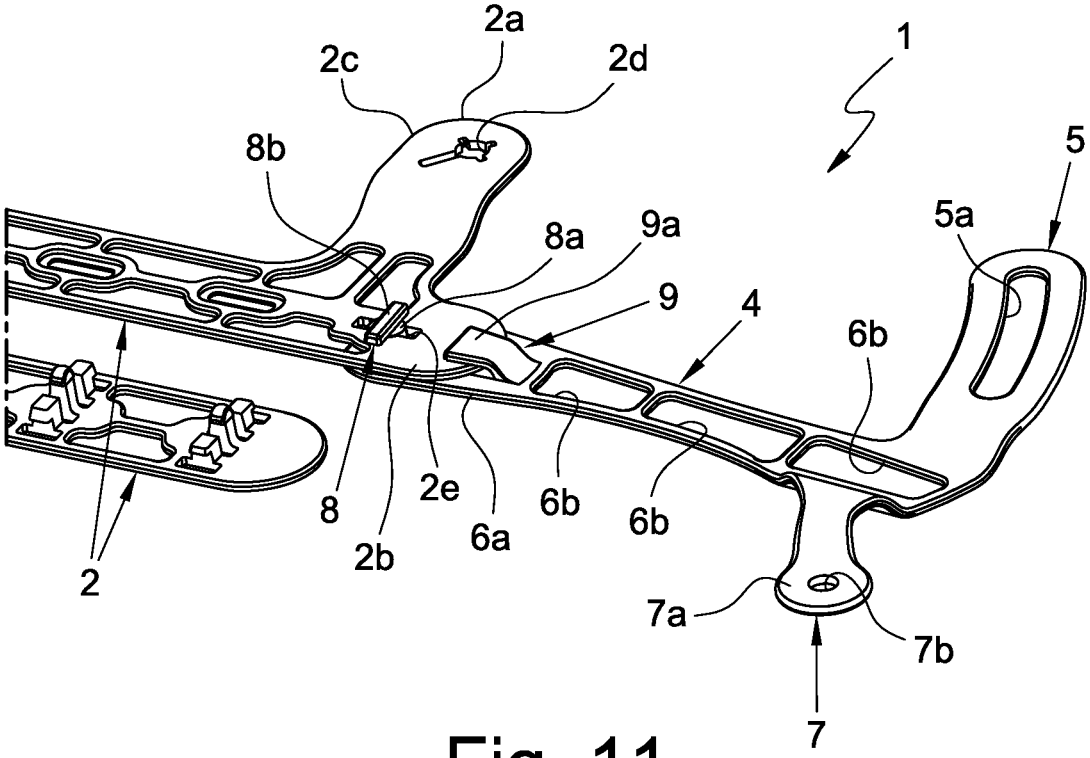
FIG. 11 is an enlargement in perspective view of a detail of FIG. 10.

As can be seen in the attached figures, the forehead support band 1 comprises an elongated structure 2, preferably flexible, able to assume an arched configuration in the mounted condition on a respective work or sports protective helmet 3 (FIGS. 1 and 2).

The structure 2 has at least one fixing appendage 2*a*, preferably two, for its fixing to the helmet 3, interposed between two opposite ends 2*b* of the structure 2.

In detail, the fixing appendages 2*a* of the structure 2 extend each from a portion of the structure 2 close to the respective end 2*b* of the latter.

As can be seen in FIGS. 1 to 4, 7, 10 and 11, each fixing appendage 2*a* of the structure 2 has—at a free end 2*c* thereof—at least one respective through-opening 2*d*, for the constraint of the same to a concave inner surface 3*a* (FIGS. 1 and 2) of the helmet 3 by means of respective constraint elements (not represented) of the latter.

Advantageously, the forehead support band 1 comprises at least two connection brackets 4 for the engagement of the structure 2 to the helmet 3 and to a size-adjustment device (not represented since it is known) arranged to engage a user's nape.

Each connection bracket 4 has a substantially flat-shaped body.

In detail, each connection bracket 4 is provided with a first engagement appendage 5 moveably engageable to the helmet 3, a second engagement appendage 6 rotatably engageable to a respective end 2*b* of the structure 2 and a third engagement appendage 7 rotatably engageable by one end of the respective size-adjustment device.

Advantageously, each connection bracket 4 is moveable with respect to the helmet 3 and to the forehead support band 1 between a raised position and a lowered position, therefore also the size-adjustment device engaged to the brackets 4, on the opposite side with respect to the structure 2 of the forehead support band 1, is moveable with respect to the helmet 3 and to the forehead support band 1 between a raised position and a lowered position.

In further detail, the first engagement appendage 5 of each connection bracket 4 develops transversely with respect to the second engagement appendage 6 and has at least one sliding slot 5*a* adapted to receive in engagement at least a respective sliding constraint element (not represented since it is known) projecting from the inner surface 3*a* of the helmet 3.

Yet further in detail, the first engagement appendage 5 of each bracket 4 is substantially arc-shaped, which is reproduced also by the sliding slot 5*a*, which is in turn substantially arc-shaped.

The second engagement appendage 6 of each connection bracket 4 develops transversely with respect to the first and third engagement appendage 5, 7 and has, at its free end 6*a*, a constraint element 8 that is rotatably engageable in a constraint seat 2*e* obtained at the respective end 2*b* of the structure 2 of the forehead support band 1.

In particular, the constraint element 8 comprises at least one rotary pin 8*a* transversely projecting from the end 6*a* of the second engagement appendage 6 of each connection bracket 4, on the upper part of which an abutment bar 8*b* having transversal dimensions greater than the dimensions of the rotary pin 8*a* lies transversely to the main development of the second engagement appendage itself.

The constraint seat 2*e* obtained in each of the ends 2*b* of the structure 2 of the forehead support band 1 is defined by a through-opening having a shape substantially reproducing the shape of the constraint element 8 of the second engagement appendage 6 of the respective connection bracket 4 and developing in the main development direction of the structure 2 of the forehead support band 1.

When the abutment bar 8*b* of the constraint element 8 of the second engagement appendage 6 of each connection bracket 4 is oriented according to the orientation of the constraint seat 2*e* of the respective end 2*b* of the structure 2, the constraint element 8 can be inserted into and removed from the respective constraint seat 2*e*, thereby facilitating the mounting and removing of the respective connection bracket 4.

When the abutment bar 8*b* of the constraint element 8 of the second engagement appendage 6 of each connection bracket 4 is oriented transversely with respect to the orientation of the constraint seat 2*e* of the respective end 2*b* of the structure 2, the constraint element 8 interferes with the respective end 2*b* of the structure 2 thus maintaining the structure 2 and the respective connection bracket 8 constrained, as illustrated in the attached figures.

Again with reference to the attached figures, the second engagement appendage 6 of each connection bracket 4 also has an auxiliary constraint element 9 cooperating with the constraint element 8 to hold the respective connection bracket 4 constrained to the respective end 2*b* of the structure 2. The auxiliary constraint element 9 of each connection bracket 4 advantageously has a constraint tab 9*a* that extends from the end 6*a* of the second engagement appendage 6 of the respective connection bracket 4, on a plane substantially parallel to the lying plane of the respective second engagement appendage 6 and along the main development direction of the latter, so as to touch the surface of the respective end 2*b* of the structure 2 when the respective connection bracket 4 is mounted on it.

Preferably, in order to lighten each connection bracket 4, the respective second appendage 6 has a substantially grid structure with two or more lightening openings 6*b*.

Again with reference to the attached figures, the third engagement appendage 7 of each connection bracket 4 develops transversely with respect to the main development of the respective second engagement appendage 6 and ends preferably with a free end 7*a* through which an engagement opening 7*b* is obtained for hinging a respective end of a respective size-adjustment device.

The forehead support band and the protective helmet provided with the same according to the present invention solve the problems observed in the prior art and achieve important advantages.

Firstly, the described forehead support band has transverse encumbrance, at the size-adjustment device, which is reduced since the connection brackets define extensions of the structure of the band itself without considerable overlapping with it.

The significant reduction of the transverse encumbrance of the band allows a significant improvement of the fit and of the comfort of the helmets also while using additional accessories, such as for example anti-noise earmuffs.

In addition, the presence of the sliding slots of the connection brackets engaged to the helmet allows to make the structure of the band more robust at the size-adjustment device, as well as to define a regular ascending and descending trajectory of the same, since it does not have undesired movements transverse to the trajectory.

The invention claimed is:

1. A forehead support band for helmets, comprising an extended structure, capable of assuming an arched configuration in the mounted condition on a helmet, the structure having at least one fixing appendage, for its fixing to the helmet interposed between two opposite ends of the structure, and at least two connection brackets for the engagement of the structure to the helmet and to a size-adjustment device arranged to engage a user's nape, each connection bracket having:

a first engagement appendage moveably engageable to the helmet;

a second engagement appendage rotatably engageable to a respective end of the structure; and a third engagement appendage rotatably engageable to the size-adjustment device;

each connection bracket being moveable with respect to the helmet and to the forehead support band between a raised position and a lowered position, the size-adjustment device engaged to the brackets is moveable with respect to the helmet and to the forehead support band between a raised position and a lowered position, and wherein the first engagement appendage of each connection bracket develops transversely with respect to the second engagement appendage and has at least one sliding slot adapted to receive at least one respective sliding constraint element of the helmet.

2. The forehead support band according to claim 1, wherein the first engagement appendage of each bracket is substantially arc-shaped, the sliding slot of the first engagement appendage of each connection bracket being substantially arc-shaped.

3. The forehead support band according to claim 1, wherein the second engagement appendage of each connection bracket develops transversely with respect to the first and third engagement appendages and has—at its free end—a constraint element that is rotatably engageable in a constraint seat obtained at the respective end of the structure of the forehead support band.

4. The forehead support band according to claim 3, wherein:

the constraint element comprises at least one rotary pin transversely projecting from the end of the second engagement appendage of each connection bracket, on the upper part of which an abutment bar having transversal dimensions greater than the dimensions of the rotary pin lies transversely to the main development of the second engagement appendage itself; and the constraint seat obtained in each of the ends of the structure of the forehead support band is defined by a through-opening having a shape substantially reproducing the shape of the constraint element of the second engagement appendage of the respective connection bracket and developing in the main development direction of the structure of the forehead support band, when the abutment bar of the constraint element of the second engagement appendage of each connection bracket is oriented according to the orientation of the constraint seat of the respective end of the structure, the constraint element is capable of being inserted into and removed from the constraint seat, when the abutment bar of the constraint element of the second engagement appendage of each connection bracket is oriented transversely with respect to the orientation of the constraint seat of the respective end of the structure, the constraint element interferes with the respective end of the structure thus maintaining the structure and the respective connection bracket constrained to each other.

5. The forehead support band according to claim 3, wherein the second engagement appendage of each connection bracket also has an auxiliary constraint element cooperating with the constraint element to hold the respective connection bracket constrained to the respective end of the structure.

6. The forehead support band according to claim 5, wherein the auxiliary constraint element of each connection bracket has a constraint tab that extends from the end of the second engagement appendage of the respective connection bracket on a plane substantially parallel to the lying plane of the respective second engagement appendage and along the main development direction of the latter, so as to touch the surface of the respective end of the structure when the respective connection bracket is mounted on it.

7. The forehead support band according to claim 3, wherein the second engagement appendage has a substantially grid structure with lightening openings.

8. The forehead support band according to claim 1, wherein the third engagement appendage of each connection bracket develops transversely with respect to the main development of the respective second engagement appendage.

9. The forehead support band according to claim 1, wherein each connection bracket has a substantially flat-shaped body.

10. A helmet comprising a structure having at least one substantially convex outer surface and at least one substantially concave inner surface adapted to receive in engagement a user's head;

and at least one forehead support band according to claim 1.

* * * * *